US007152768B2

(12) United States Patent
Petrou

(10) Patent No.: US 7,152,768 B2
(45) Date of Patent: Dec. 26, 2006

(54) HANGER HAVING A LOCKING BAR

(76) Inventor: Nicoleon Petrou, 2498 Rol Dr., #407, San Diego, CA (US) 92173

( * ) Notice: Subject to any disclaimer, the term of this patent is extended or adjusted under 35 U.S.C. 154(b) by 378 days.

(21) Appl. No.: 10/606,516

(22) Filed: Jun. 26, 2003

(65) Prior Publication Data

US 2004/0262341 A1 Dec. 30, 2004

(51) Int. Cl.
*A41D 27/22* (2006.01)

(52) U.S. Cl. ..... 223/85; 223/95

(58) Field of Classification Search ..... 223/85, 223/88, 91, 95, 96
See application file for complete search history.

(56) References Cited

U.S. PATENT DOCUMENTS

| | | | | | |
|---|---|---|---|---|---|
| 617,130 | A | * | 1/1899 | Skinner | 223/96 |
| 2,149,674 | A | * | 3/1939 | Hendrix | 223/95 |
| 2,150,869 | A | * | 3/1939 | Shafarman | 223/88 |
| 2,492,287 | A | * | 12/1949 | Hogan | 223/93 |
| 3,115,995 | A | * | 12/1963 | McLean | 223/91 |
| 3,209,967 | A | * | 10/1965 | Hasselback | 223/96 |
| 3,407,979 | A | * | 10/1968 | Patch | 223/88 |
| 4,120,433 | A | * | 10/1978 | Meckstroth | 223/95 |
| D279,236 | S | * | 6/1985 | Kupchik | D6/317 |
| 4,556,158 | A | * | 12/1985 | Blanchard et al. | 223/88 |
| 4,813,581 | A | * | 3/1989 | LaMont | 223/94 |
| 4,865,236 | A | * | 9/1989 | Dongas | 223/88 |
| 4,951,855 | A | * | 8/1990 | Jacobson et al. | 223/88 |
| 4,978,043 | A | * | 12/1990 | Uke | 223/88 |
| 5,562,237 | A | * | 10/1996 | Saliaris | 223/96 |

FOREIGN PATENT DOCUMENTS

| | | | |
|---|---|---|---|
| DE | 4343221 | A1 * | 7/1994 |
| DE | 4306355 | A1 * | 8/1994 |
| EP | 362482 | A1 * | 4/1990 |
| GB | 2273867 | A * | 7/1994 |
| JP | 05329041 | A * | 12/1993 |

* cited by examiner

*Primary Examiner*—Rodney Lindsey
(74) *Attorney, Agent, or Firm*—Scully, Scott, Murphy & Presser

(57) ABSTRACT

A hanger having a first hook portion extending above a central body portion has at least one arm extending laterally outward from the central body portion to a first distal end. At least one locking bar has a first end and is secured along the first arm extending adjacent the first arm to a second end. Additionally, at least one support bar can be provided having a third end and secured along the first arm extending beneath the first locking bar to a fourth end. Either or both of the second and fourth ends may extend beyond a midpoint of the hanger. A second support bar and/or a second locking bar may be provided. The locking bar deflects under the weight of the hung article to engage an article between the locking bar and a support.

20 Claims, 10 Drawing Sheets

HANGER HAVING A LOCKING BAR

BACKGROUND OF THE INVENTION

1. Field of Invention

The present invention relates to the field of hangers and more particularly to a hanger having a locking bar for securely suspending an article.

2. Description of Related Art

Many types of hangers have been developed for suspending a folded article, e.g., a pair of trousers. For various reasons, all have proven unsatisfactory. Taking first the most basic example, a triangular-shaped twisted wire hanger. This proves incapable of holding most folded articles, unless the article is precisely balanced over lower the bar of the hanger, because of the narrow diameter and smooth surface of the wire. To overcome this problem, a paperboard insert is often placed over the bar. An adhesive or friction-enhanced coating may also be applied to the upper side of the insert. The width of the paperboard insert, in combination with the increased friction of the surface, either natural or enhanced, can accommodate some imbalance, thereby improving results, but not to the desired holding capacity and reliability. It would also be advantageous to provide a single piece hanger adequate to reliably hold a folded article.

Another unsatisfactory solution is shown schematically in the Prior Art example of FIG. 9. As shown in FIG. 9, a hanger, generally 2, has solid lower bar 4 to support a folded article. Provided beneath the lower bar 4 extending below the bar and inward from each end are holding tabs 6. In use, the intent of this device is that the article is folded over the lower bar 4, and then positioned between the bar 4 and the tabs 6. It is presumed that the friction of the article against both the lower bar 4, and the tabs 6, and itself are adequate to prevent an unbalanced article from sliding off the lower bar 4 in most circumstances. In practice, however, results are unsatisfactory. First, there are circumstances where the article is very sheer and simply does not provide adequate friction to hold even the slightest imbalance. Additionally, even for most garments that can provide nominal friction, the tabs 6 are too short to appreciably hold the article. In addition, the short length of the tabs 6 makes them largely inflexible. It is therefore difficult to position the article between the lower bar 4 and the tabs 6 as intended.

BRIEF SUMMARY OF THE INVENTION

In order to overcome these and other drawbacks in the prior art, provided herein is a hanger having a first hook portion extending above a central body portion, first and second arms, each extending laterally outward from the central body portion to a respective first and second distal end. A first locking bar has a first end and is secured distally along the first arm extending inward towards the central body portion beneath the first arm to a second end. A first support bar has a third end and is secured distally along the first arm extending inward towards the central body portion beneath the first locking bar to a fourth end. A second support bar has a fifth end secured distally along the second arm and extends inward towards the central body portion beneath the second arm to a sixth end.

In a further embodiment, the hanger further includes a second locking bar having a seventh end secured distally along the second arm and extending inward towards the central body portion beneath the second arm and above the second support bar to an eights end.

In an alternate embodiment of a hanger according to the present invention, the hanger comprises a first hook portion extending above a central body portion, first and second arms, each extending laterally outward from the central body portion to a respective first and second distal end. A first locking bar having a first end is secured along the first arm and extends inward toward the central body portion and beneath the first arm to a second end. A first support bar having a third end is secured along the second arm and extends inward towards the central body portion at least to the second end of the first locking bar and beneath the first locking bar to a fourth end.

In yet another embodiment of a hanger according to the present invention, the hanger comprises a first hook portion extending above a central body portion, a first arm extending laterally outward from the central body portion to a first distal end. A first locking bar having a first fixed end is secured along the first arm and extends inward beyond a midpoint of the hanger and beneath the first arm to a first free end. A first support bar having a second fixed end is secured distally along the first arm and extends inward beyond a midpoint of the hanger and beneath the first locking bar to a second free end.

In a further embodiment of the present invention, a lower surface of the locking bar and/or an upper surface of the support bar are provided with complementary profiles, such as flat, convex or concave curvatures, saw-tooth, S-curves, or V-shapes.

In yet another embodiment of a hanger according to the present invention, the hanger comprises a first hook portion extending above a central body portion, and first and second arms, each extending laterally outward from the central body portion to respective first and second distal ends. A first locking bar has a first end secured to the hanger and extends adjacent the first arm to a second end, wherein the first locking bar is dimensioned to deflect to interface a support under a predetermined minimum force.

In a further embodiment, the support comprises one of the first arm, and a first support bar having a fifth end secured to the hanger and extending adjacent the first locking bar to a sixth end. Also in a further embodiment, the first locking bar is positioned above the first arm. A second similar locking bar may also be provided.

Also provided according to the present invention is method for hanging a flexible article including providing a hanger having at least a hook portion, a support bar beneath the hook portion and a flexible locking bar between the support bar and the hook portion, and folding the flexible article over itself at least once. One side of the folded article is positioned between the locking bar and the support bar; another side of the folded article is positioned above the locking bar. The weight of the article deflects the locking bar into engagement with the support bar, thereby securing the side of the folded article located therebetween.

BRIEF DESCRIPTION OF THE DRAWINGS

These and other features, advantages and benefits of the present invention will be made apparent with reference to the following specification and the accompanying drawings, where like reference numerals refer to like structures across the several views.

DETAILED DESCRIPTION OF THE INVENTION

Figure 1:
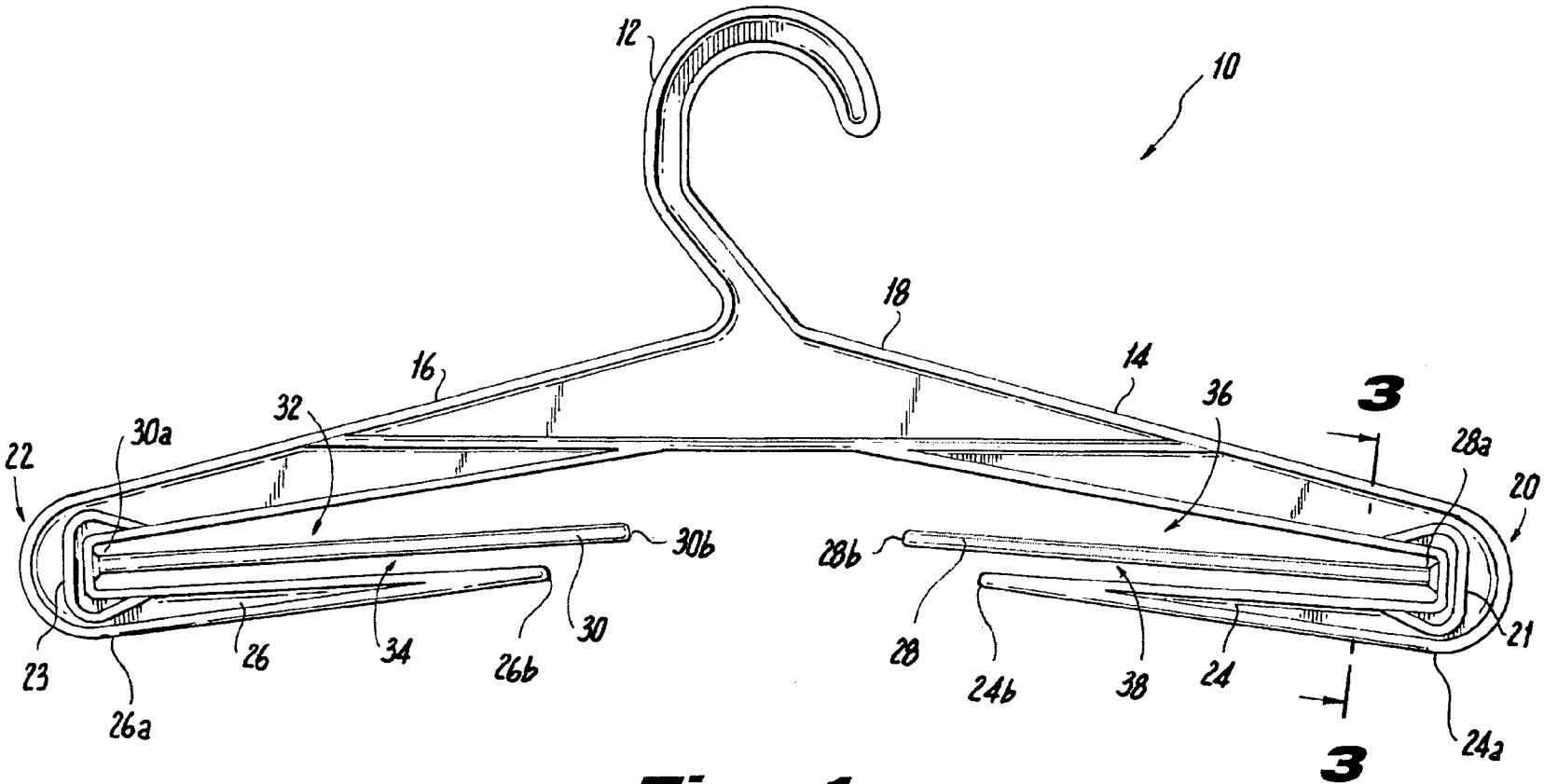
FIG. 1 illustrates a hanger according to a first embodiment of the present invention.

Turning now to FIG. 1, a first embodiment of a hanger, generally 10, according to the present invention is illustrated. Hanger 10 has a first hook portion 12 for engaging a bar or other support by which the hanger can be supported. Beneath the first hook portion 12, a first arm 14 and a second arm 16 extend laterally outward, typically, but not exclusively, in a coplanar fashion, from a central body portion 18. Central body portion 18 need only be as large as necessary to join either of first and second arms 14, 16 with the first hook portion 12. In this particular embodiment, first and second arms 14, 16, respectively, sweep downward beneath the first hook portion 12 and the central body portion 18. This can differ, however, without departing from the scope of the invention. For example, the arms 14, 16, may extend outward from the central body portion in a level fashion, or may even sweep upward. Either arm may sweep upward or downward, or not at all, irrespective of any sweep of lack thereof in the other arm.

First arm 14 extends laterally outward to a first distal end 20. Second arm 16 extends laterally outward to a second distal end 22. Secured at a distal point along first arm 14 is a first locking bar 28. First locking bar 28 extends from a first fixed end 28*a* inward towards central body portion 18 beneath first arm 14 to a first free end 28*b*.

Secured at a distal point along first arm 14 is a first support bar 24. First support bar 24 extends from a second fixed end 24*a* inward towards central body portion 18 beneath first locking bar 28 to a second free end 24*b*. Secured at a distal point along second arm 16 is a second support bar 26. Second support bar 26 extends from a third fixed end 26*a* inward towards central body portion 18 beneath second arm 16 to a third free end 26*b*.

Secured at a distal point along second arm 16 is a second locking bar 30. Second locking bar 30 extends from a fourth fixed end 30*a* inward towards central body portion 18 beneath second arm 16 and above second support bar 26 to a fourth free end 30*b*.

In this embodiment, first and second locking bars 28, 30, respectively, and first and second support bars, 24, 26, respectively sweep upward beneath the first and second arm 14, 16, towards the central body portion 18. This is provided in the preferred embodiment first, to anticipate the downward deflection of the free ends, 24*b*, 26*b*, 28*b*, 30*b*, under the weight of the article to be hung. As a result, the first and second locking bars 28, 30, respectively, and first and second support bars, 24, 26, respectively, approach a level condition in use.

Additional sweep beyond what is necessary to anticipate deflection can be provided in connection with closing the space 32 and space 34 at fixed ends 30*a* and 26*a*, respectively. As a result, if the article were to slip from between the locking bar 30 and support bar 26, it would tend to slide down the sweep into the closed end of the space, and remain suspended from the hanger 10. Similar closure can be provided at fixed ends 24*a*, 28*a* for similar effect.

The direction or presence of sweep in the first and second locking bars 28, 30, respectively, and first and second support bars, 24, 26, can differ, however, without departing from the scope of the invention. For example, the locking bars 28, 30, and the support bars 24, 26, may extend inward toward the central body portion in a level fashion, or may even sweep downward, irrespective of any upward or downward sweep, or lack of sweep in the arms 14, 16. Neither is it necessary for the locking bar and support bar to be parallel or near parallel within the scope of the present invention.

Figure 3:
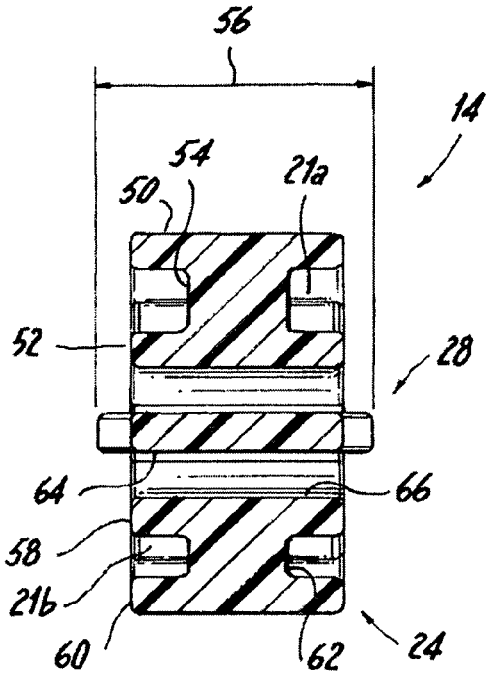
FIG. 3 illustrates a cross-sectional view of the first embodiment taken along line 3—3 of FIG. 1.

FIG. 3 illustrates a cross-sectional view of hanger 10 taken along line 3—3 of FIG. 1. It will be recognized by those skilled in the art that the following examples are merely illustrative, and variations are possible without departing from the scope of the invention. In the exemplary embodiment, first arm 14 has the general shape of an "I" beam, with an upper flange 50 and a lower flange 52 connected by a web 54. Locking bar 28 has a generally rectangular cross section, and may have some rounding of its corners. It is advantageous for a locking bar to have a good deal of flexibility in both the vertical and lateral directions, from the viewpoint of FIG. 3. However, for additional strength, the locking bar 28 can have an increased cross-sectional area in the region of its fixed end.

As seen in FIG. 3, locking bar 28 has a wider dimension 56 in the region of first fixed end 28*a* than either along its length or in the region of first free end 28*b*. At the point of connection of the first fixed end 28*a*, however, the wider dimension 56 can again be narrowed, in order to avoid stress concentrations.

In one embodiment, the lower surface 64 of locking bar 28 and/or the upper surface 66 of support bar 24 are generally flat, providing one example of complementary profiles. This arrangement has the advantage of providing more surface area, as compared to cylindrical bars, for the engagement of the article between the locking bar 28 and the support bar 24 when the locking bar 28 is deflected downward under the weight of the hung article. This will be explained further with respect to the operation of the present invention, infra.

Alternately, the lower surface of the locking bar 28 and the upper surface 66 of the support bar 24 can be provided with complementary and/or mating non-flat profiles, such as convex or concave curvatures, saw-tooth, S-curves, or V-shapes. Complementary profiles are those deigned totenhance the engagement between the locking bar 28 and the support bar 24, other examples of which would be opposing V-shapes arranged to engage generally point-to-point, and S-shapes or saw-tooth shapes arranged to engage generally peak-to-peak. A subset of such complementary profiles are those that mate together to substantially eliminate all space between the two, such as V-shapes, S-shapes, or saw-tooth shapes arranged to engage generally peak-to-valley.

At the point of FIG. 3, support bar 24 also exhibits an "I" beam cross section, having an upper flange 58 and a lower flange 60 connected by web 62. The support bar also can benefit by additional strength at the third fixed end 24*a*. In this case, that is accomplished by varying the height of the web 62 along the length of the support bar 24. The exemplary embodiment employs a constant-stress method known in the art, varying the height of the web linearly with distance from the third fixed end 24*a*. In the region of third free end 24*b*, the height of web 62 shrinks to nil, while the upper flange 58 and lower flange 60 converge.

Referring again to FIG. 1, shown in the region of first distal end 20 is a secondary flange 21. The secondary flange connects the lower flange 52 of first arm 14 with the upper flange 58 of support bar 24 to strengthen the junction. In FIG. 3, an upper portion 21*a* and a lower portion 21*b* of secondary flange 21 can be seen. Second distal end 22 is also illustrated having a secondary flange 23.

The use and operation of the present invention will be described. A pair of trousers will be described as an archetypical folded hanging article of clothing, however it will be recognized that the present invention is equally applicable to any flexible article, clothing or other articles. Such flexible articles can include, but are not limited to, sweaters, skirts, tablecloths, rugs, tapestries, unfinished textiles, and webs, sheets or films of paper or other material.

Returning to the exemplary pair of trousers, it will be folded at least one time over itself prior to hanging. One side of this fold will be positioned in the space 32 above the locking bar 30. The other side of the fold will be positioned in the space 34 between the locking bar 30 and the support bar 26. In this position, both sides of the folded article will be positioned on the same side of the support bar 26. This process is repeated on the opposite side of the hanger 10, with locking bar 28 and support bar 24.

When suspended, the weight of the trousers will deflect the locking bars 28, 30 downward into engagement with the support bars 24, 26, securely holding the trousers in place. Once the locking bars 28, 30 and the support bars 24, 26, are engaged together under the weight of the trousers, the combined vertical rigidity of the locking bars 28, 30 and the support bars 24, 26, serve to support the full weight of the trousers.

Other features of the hanger 10 add further utility. The locking bars 28, 30, are dimensioned to have flexibility to deflect vertically under the weight of the trousers to engage the support bar. It is also advantageous for the locking bar to exhibit considerable flexibility in the lateral direction, as viewed in FIG. 3, to aid in locating the article for secure hanging. This can be accomplished with appropriate dimensioning of the locking bar cross section in connection with the selection of a material having a suitable modulus of elasticity.

To further assist in positioning the article, the first free end 28*b* of the first locking bar 28 and/or the second free end 30*b* of the second locking bar 30 are positioned further inward than the third free end 24*b* of first support bar 24 and/or fourth free end 26*b* of second support bar 26, respectively. Therefore, the first and, second free ends 28*b*, 30*b*, are clear of the support bar which could otherwise obstruct access.

Figure 1A:
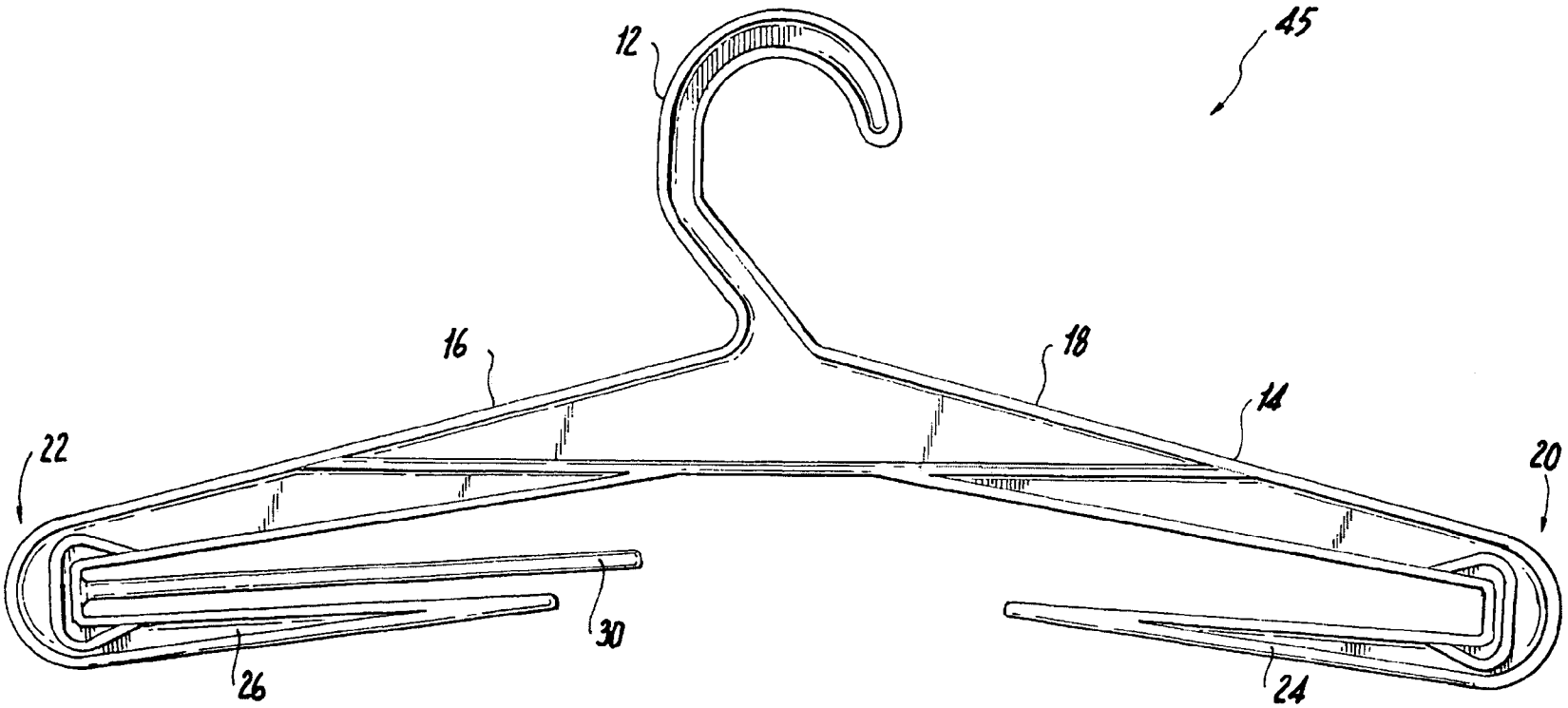
FIG. 1*a* illustrates a second embodiment of the present invention.

FIG. 1*a* illustrates a second embodiment of the present invention. This hanger, generally 45, differs from the hangar 10 primarily in that it has only one locking bar, 30, and a first and second support bars, 24 and 26. In operation, the article will be positioned generally as described above with respect to the embodiment of FIG. 1. However, in the absence of locking bar 28, the folded article is straddled over the support bar 24.

Figure 1B:
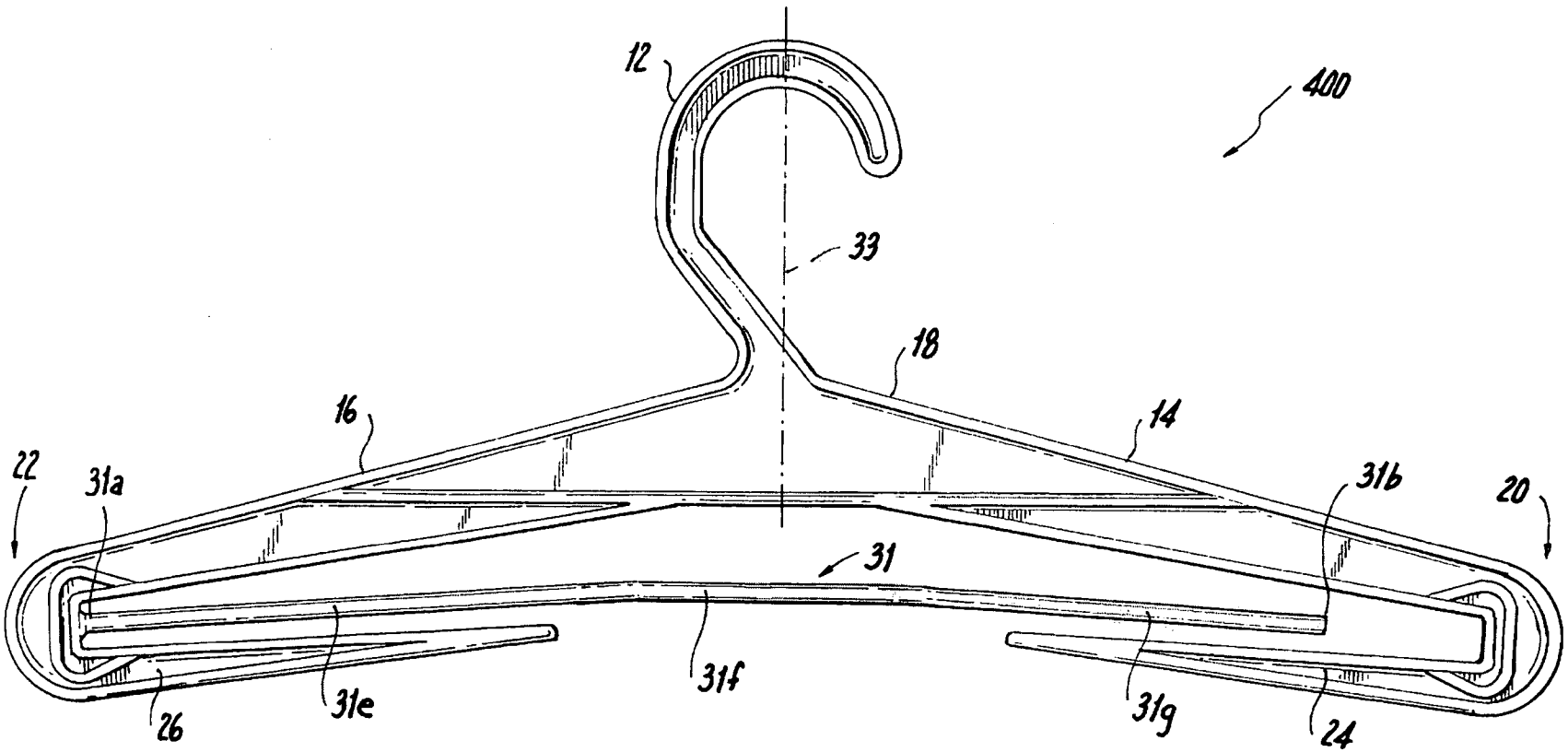
FIG. 1*b* illustrates a third embodiment of the present invention.

FIG. 1*b* illustrates a third embodiment of the present invention. This hanger, generally 400, like hanger 45 has only one locking bar, 31, and a first and second support, bars, 24 and 26. Locking bar 31 extends from a fixed end 31*a* inward towards central body portion 18 beneath second arm 16 and above second support bar 26. Locking bar 31 extends further beyond a midpoint of central body 18, indicated by centerline 33, to a free end 31*b*.

In the embodiment shown, locking bar 31 has proximal portion 31*e*, proximal to the fixed end 31*a*, a medial portion 31*f*, and a dittal portion 31*g*. Where first or second support bars 24, 26 are provided with upward or downward sweep, the portion of the locking bar 31 that engages the respective support bar under the weight of the article can be, but need not be, provided with complementary sweep.

As shown in the example of FIG. 1*b*, proximal portion 31*e* is swept upward to complement the sweep of support bar 26. Distal portion 31*g* is swept to complement the sweep of support bar 24. Medial portion 31*f* is shown to be horizontal, however it can also have some other angle of inclination irrespective of the proximal and distal portions 31*e*, 31*g*. Alternately, medial portion 31*f* may be effectively eliminated, such that proximal and distal portions 31*e*, 31*g* meet at a point. Sweep need not be discontinuous, as shown; it may take the form of a smooth curvature. In the use of hanger 400, an article will be positioned generally as described above with respect to the embodiment of FIG. 1.

Figure 2:
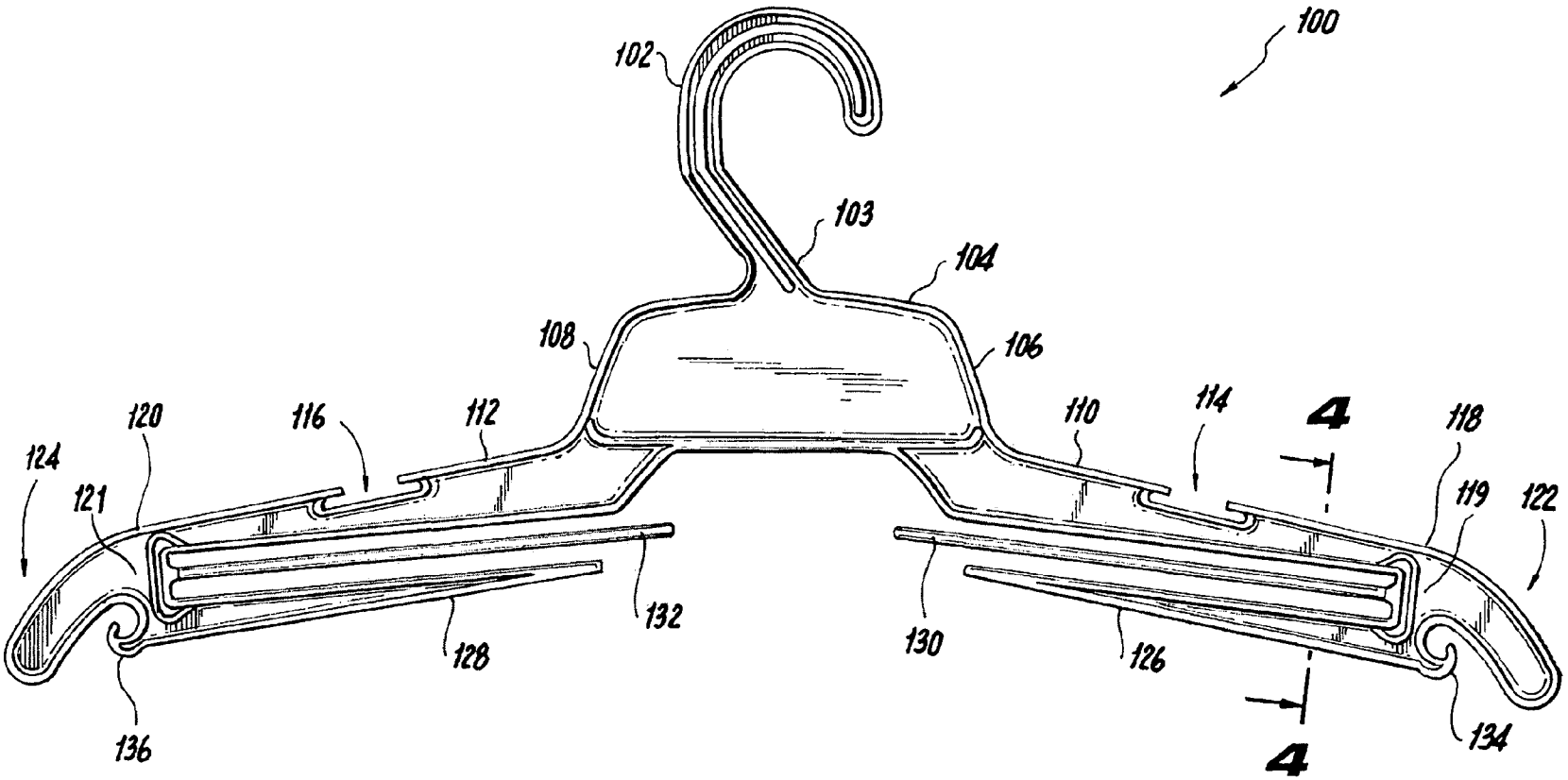
FIG. 2 illustrates a hanger according to a fourth embodiment of the present invention.

Referring now to FIG. 2, shown is a fourth embodiment of a hanger, generally 100, according to the present invention. This hanger will be seen to have many features similar to that of the first embodiment shown in FIG. 1, therefore a detailed description will be omitted.

Hanger 100 has a first hook portion 102 extending above a central body portion 104. First arm 110 and second arm 112 extend laterally outward from the central body portion 104. First arm 110 extends outward to a first distal end 122, and second arm 112 extends outward to a second distal end 124.

Secured at a distal point along first arm 110 is a first locking bar 130. First locking bar 130 extends inward towards central body portion 104 beneath first arm 110. Secured at a distal point along second arm 112 is a second locking bar 132. Second locking bar 132 extends inward towards central body portion 104 beneath second arm 112.

Secured at a distal point along first arm 110 is a first support bar 126. First support bar 126 extends inward towards central body portion 104 beneath first locking bar 130. Secured at a distal point along second arm 112 is a second support bar 128. Second support bar 128 extends inward towards central body portion 104 beneath second locking bar 132. It will be recognized that the hanger 100 of this embodiment can be provided with only a single locking bar, in a manner similar to hanger 45, without departing from the scope of the invention.

This second embodiment 100 has additional features that make it suitable for supporting a wide variety of articles, particularly clothing. Central body portion 104 has inclined edges 106, 108, on either side. These edges serve to support and to form the collar portion of a collared shirt or blouse that may be hung from the hanger 100. Further outward along either arm 110, 112, each arm is provided with a recess 114, 116, respectively. The recess shown is known in the art as a strap holder, and functions to hold the shoulder straps of a garment to be hung which is so provided. The recess 114, 116, may also by provided such that the upper surface 118, 120 overhangs at least a portion of the recess, in order to more reliably hold the strap. Recess 114, 116, may also be provided with a flange on its lower surface to provide additional width to support the strap.

Figure 4:
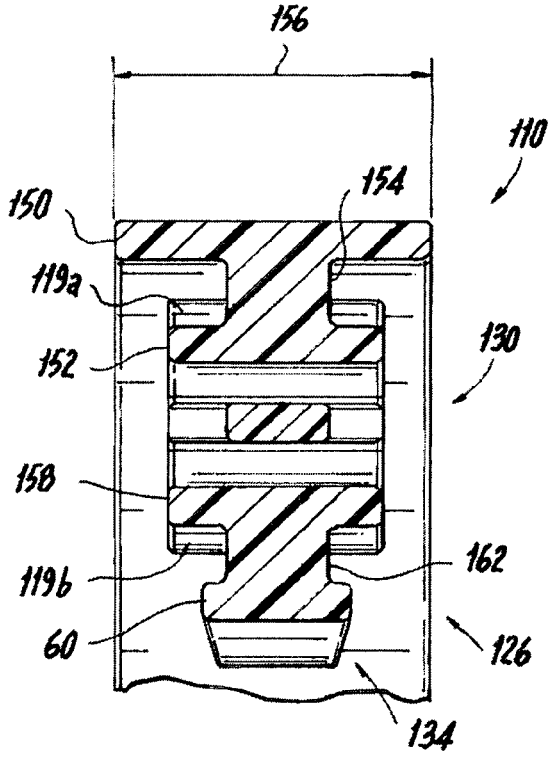
FIG. 4 illustrates a cross-sectional view of the alternate embodiment taken along line 4—4 of FIG. 2.

Referring now to FIG. 4, a cross-sectional view of hanger 100 taken along line 4—4 of FIG. 2. First arm 110 can be seen to have an upper flange 150 and a lower flange 152, connected by a web 154. Upper flange 150 has a wider width 156 on its upper surface 118. A similar construction may be provided on upper surface 120 of second arm 112. The wider width 156 is advantageous to support a jacket or other article of clothing that would typically be suspended over the arms of a hangar.

It is, however, also advantageous to limit the width of the hanger 100, particularly at the hook. Therefore, according to the present invention, the upper surface 118 of first arm 110 has a greater width in the region of the first distal end 122 than in the region adjacent the central body portion 104. In a more preferred embodiment, the width of the upper surface 118 increases linearly with the distance from the central body portion 104, notwithstanding the opening for recess 114. In the more preferred embodiment, where the recess 114 is provided with a flange on its lower portion, the width of the flange is the same as what the upper surface 118 is at that distance from the central body 104, or would had been, but for the opening of the recess. Additionally, to improve the strength of the first hook portion 102 while maintaining a minimum width, the first hook portion can be provided with an additional central rib 103.

Referring back to FIG. 2, a second hook portion 134 is located along an underside of the first arm 110 in the region of the first distal end 122. Additionally, a third hook portion 136 is located along an underside of the second arm 112 in the region of the second distal end 124. The second and third hook portions 134, 136, are useful to suspend certain garments of clothing, for example ladies' skirts, which are often provided with loops for that purpose.

Turning again to FIG. 4, the locking bar 130 has a greater cross-sectional area at its fixed end than at the section line, although the dimension does not exceed that of any other flange. First support bar 126 is also shown having an upper flange 158, and a lower flange 160, connected by a web 162. In this particular embodiment, like the first embodiment, the height of the web 162 decreases linearly with the distance from the fixed end of the support bar 126 to nil at the free end, thereby merging the upper flange 158 and the lower flange 160. Additionally in this embodiment, width of the lower flange 160 decreases linearly from the free end of the support bar 126 to a width approximately that of the second hook portion 134.

Also shown in FIG. 4 is the outline of a secondary flange 119, namely an upper portion 119*a* and a lower portion 119*b* of secondary flange 119. Secondary flange 119 connects the lower flange 152 of first arm 110 with the upper flange 158 of support bar 126 to strengthen the junction. In FIG. 2, second distal and 124 is also illustrated having a secondary flange 121.

Figure 5:
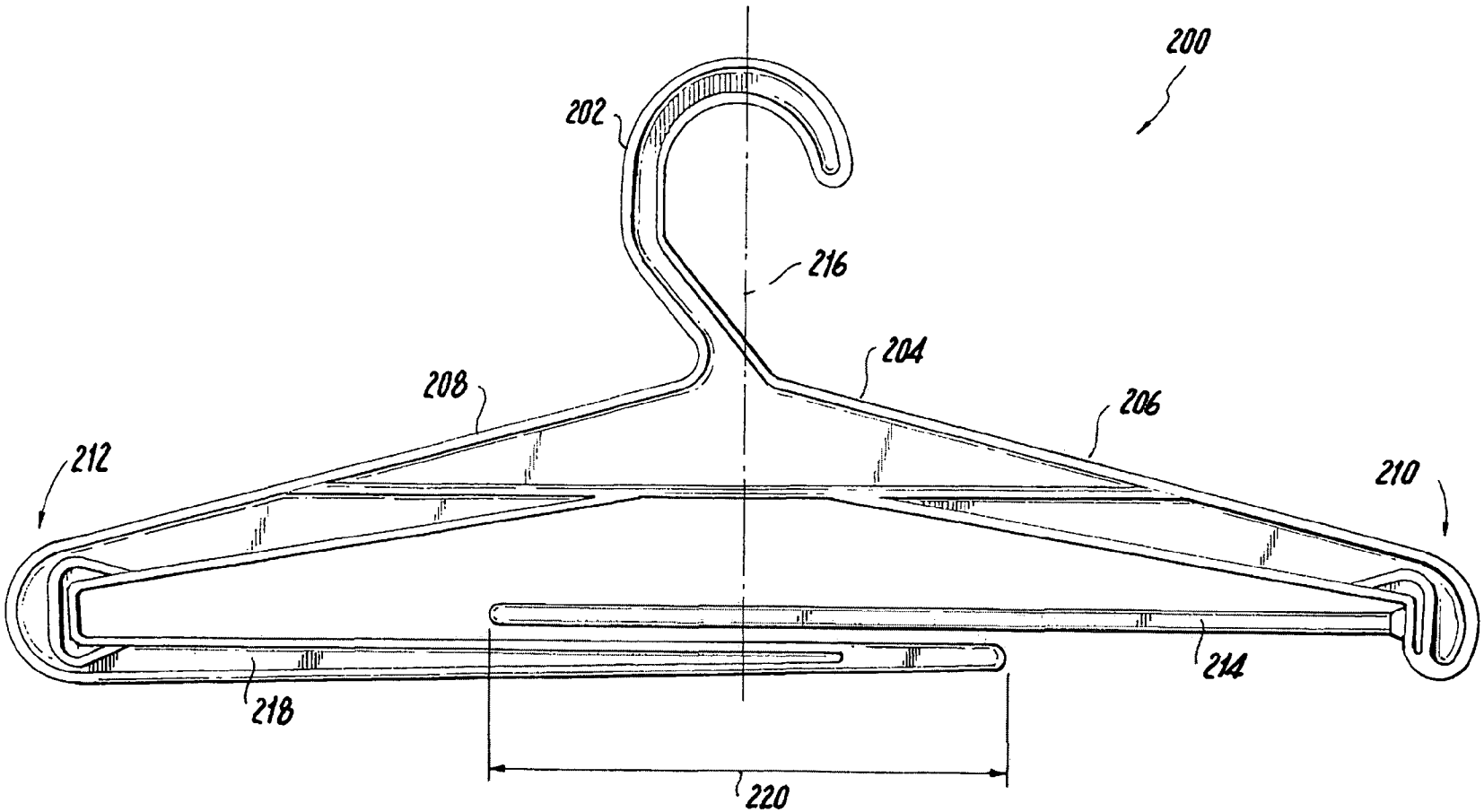
FIG. 5 illustrates a fifth embodiment of a hanger according to the present invention.

Turning now to FIG. 5, a fifth embodiment of a hanger, generally 200, according to the present invention is illustrated. This hanger will be seen to have many features similar to that of the first embodiment shown in FIGS. 1 and 2, therefore a detailed description will be omitted.

Hanger 200 has a first hook portion 202 extending above a central body portion 204. First arm 206 and second arm 208 extend laterally outward from the central body portion 204. First arm 206 extends outward to a first distal end 210, and second arm 208 extends outward to a second distal end 212.

Secured at a distal point along first arm 206 is a locking bar 214. Locking bar 214 extends inward beyond a midpoint of central body portion 204, indicated by centerline 216, beneath first arm 206. Secured at a distal point along second arm 208 is a support bar 218. Support bar 218 extends inward beyond a midpoint of central body portion 204, indicated by centerline 216, beneath locking bar 214. The length of the region of overlap 220 between the locking bar 214 and support bar 218 can be varied, as can its lateral position along the width of the hanger 200. A longer region of overlap will improve the engagement of the article between the locking bar 214 and the support bar 218, and will improve the ease of use, because the locking bar can be made more flexible by increasing its length.

Figure 6:
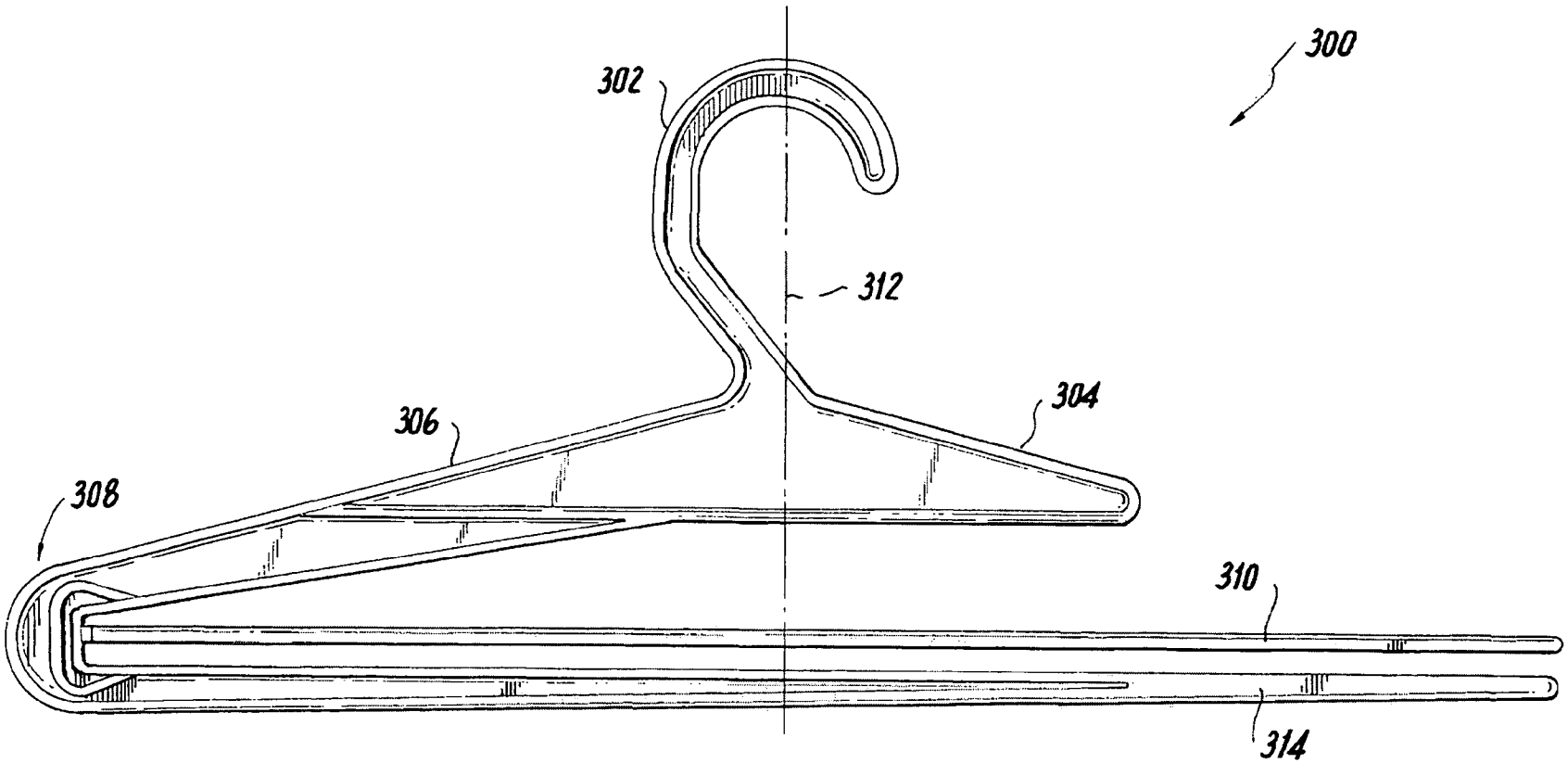
FIG. 6 illustrates a sixth embodiment of a hanger according to the present invention.

Referring now to FIG. 6, a sixth embodiment of a hanger, generally 300, according to the present invention is illustrated. This hanger will be seen to have many features similar to that of the first embodiment shown in FIGS. 1 and 2, therefore a detailed description will be omitted.

Hanger 300 has a first hook portion 302 extending above a central body portion 304. First arm 306 extends laterally outward from the central body portion 304 to a first distal end 308. Secured at a distal point along first arm 306 is a locking bar 310. Locking bar 310 extends inward beyond a midpoint of central body portion 304, indicated by centerline 312, beneath first arm 306. Secured at a distal point along second arm 306 is a support bar 314. Support bar 314 extends inward beyond a midpoint of central body portion 304, indicated by centerline 312, beneath locking bar 310.

Figure 7:
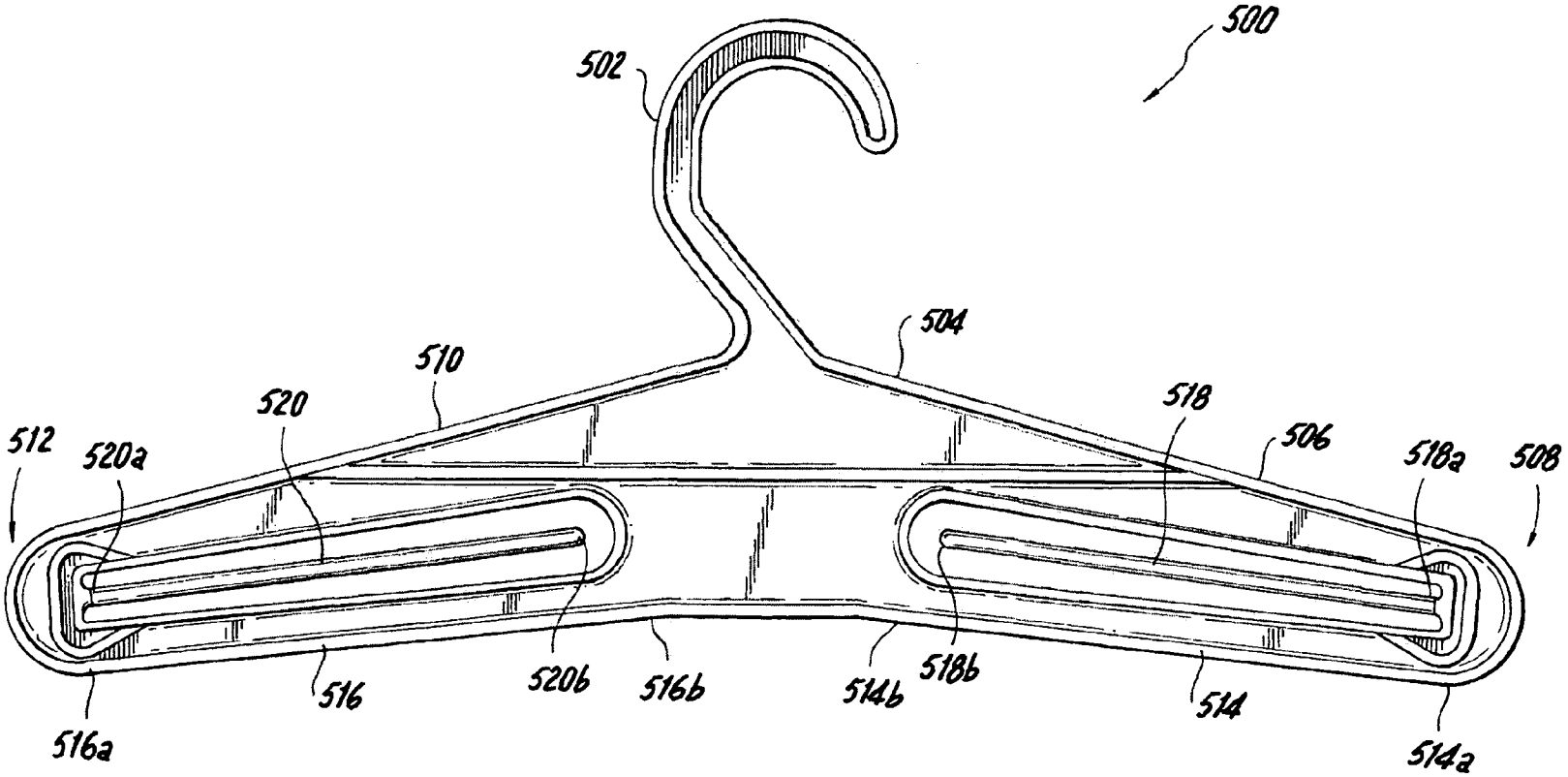
FIG. 7 illustrates a seventh embodiment of a hanger according to the present invention.

Referring now to FIG. 7, a seventh embodiment of a hanger, generally 500, according to the present invention is illustrated. This hanger will be seen to have many features similar to that of the first embodiment shown in FIGS. 1 and 2, therefore a detailed description will be omitted.

Hanger 500 has a first hook portion 502 extending above a central body portion 504. First arm 506 extends laterally outward from the central body portion 504 to a first distal end 508. Second arm 506 extends laterally outward from the central body portion 504 to a second distal end 512.

Secured along the length of first arm 506 is a first support bar 514. First support bar 514 extends from a first fixed end 514*a* inward towards central body portion 504 to a second fixed end 514*b*. Secured along the length of second arm 510 is a second support bar 516. Second support bar 516 extends from a third fixed end 516*a* inward towards central body portion 504 to a fourth fixed end 516*b*.

Also secured along first arm 506 is a first locking bar 518. First locking bar 518 extends from a fifth fixed end 518*a* inward towards central body portion 504 above first support bar 514 to a first free end 518*b*. Secured along second arm 510 is a second locking bar 520. Second locking bar 520 extends from a sixth fixed end 520*a*inward towards central body portion 504 above second support bar 516 to a second free end 520*b*. Hanger 500 operates in a similar fashion to the embodiments shown in FIGS. 1 and 2, in that the article to be suspended is placed both between a locking bar and a support bar and above a locking bar. The weight of the article will deflect the locking bar into engagement with the support bar, securely holding the article by the portion therebetween.

Figure 8:
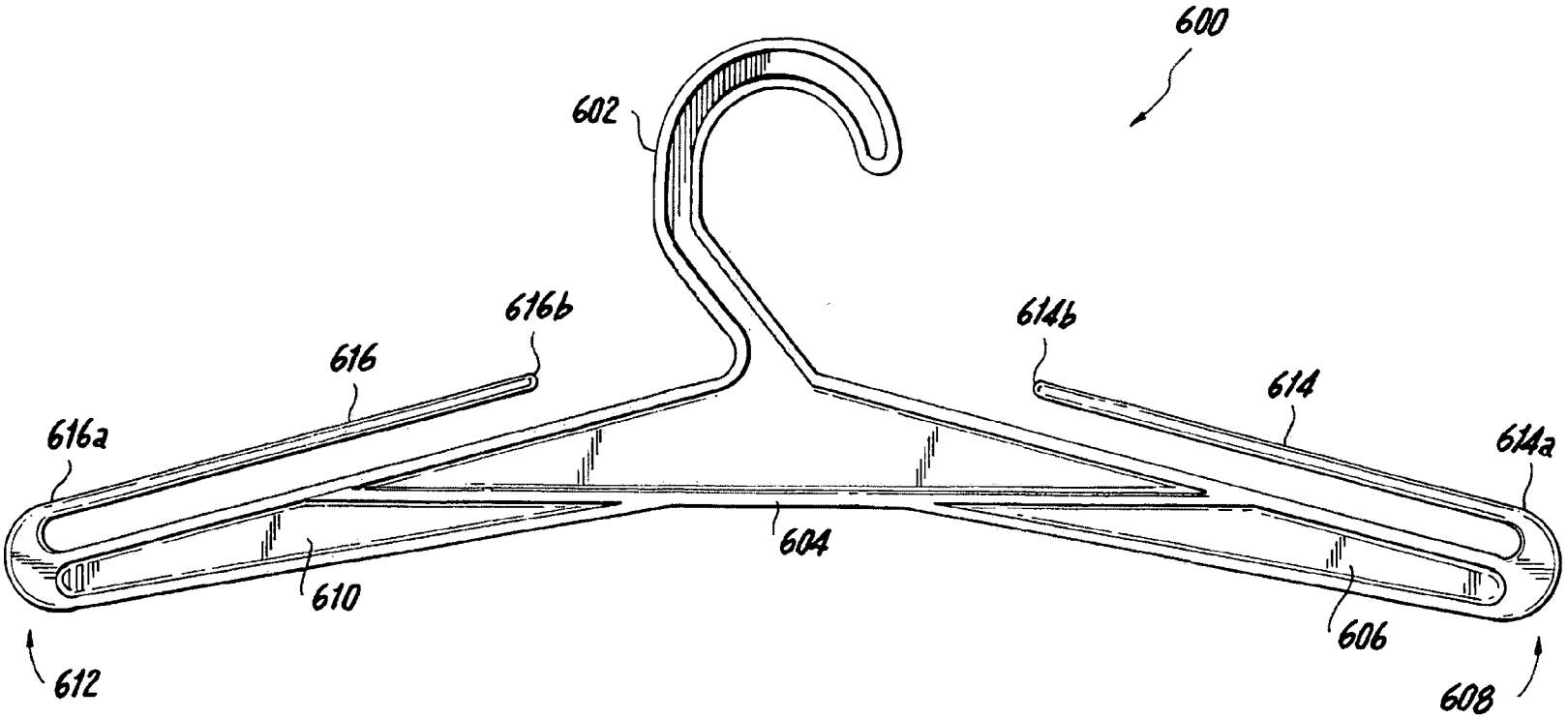
FIG. 8 illustrates a eighth embodiment of a hanger according to the present invention.
Figure 9:
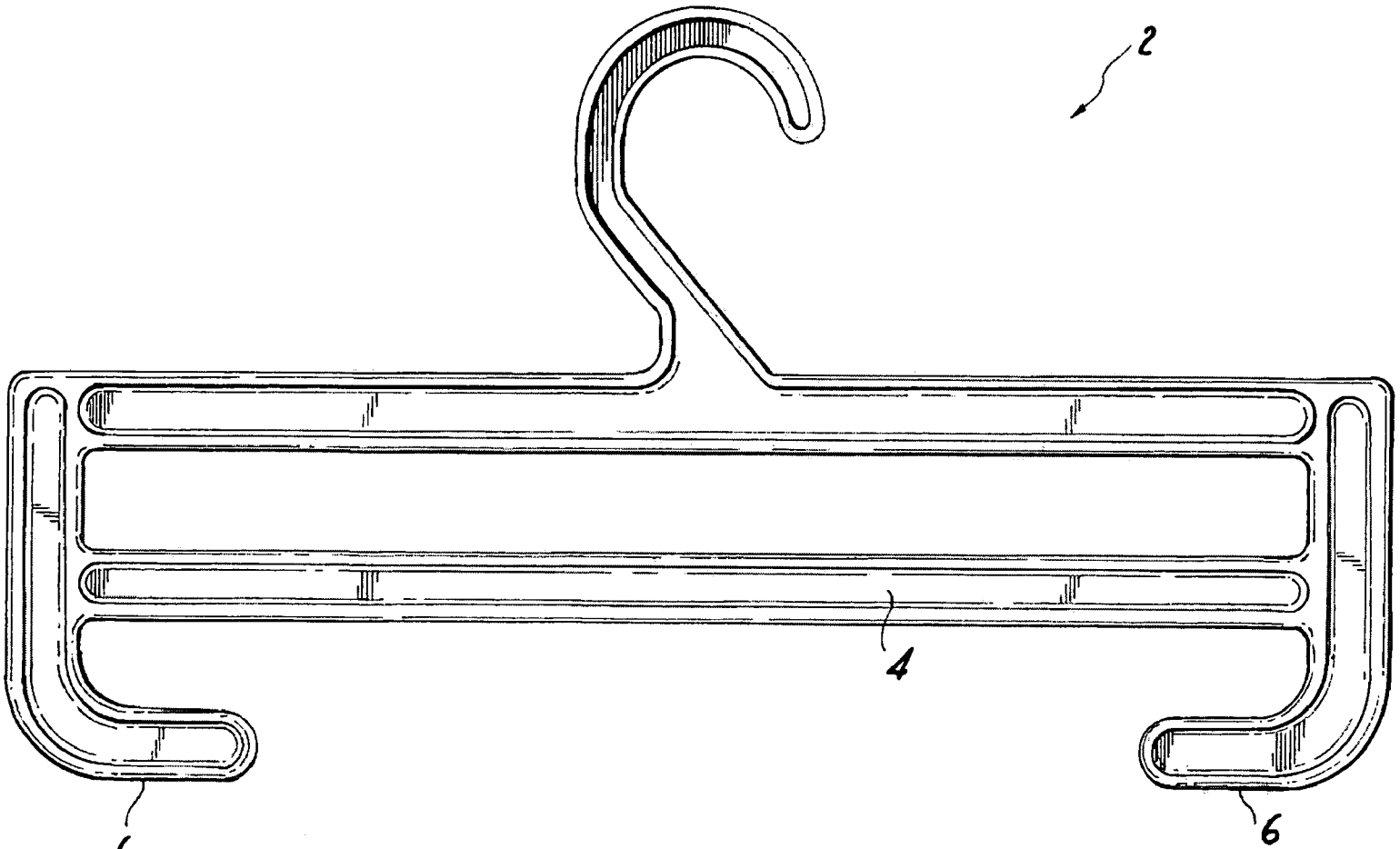
Fig. 9 (Prior Art)
FIG. 9 illustrates a hanger according to a known prior art.

Referring now to FIG. 8, an eighth embodiment of a hanger, generally 600, according to the present invention is illustrated. This hanger will be seen to have many features similar to that of the first embodiment shown in FIGS. 1 and 2, therefore a detailed description will be omitted.

Hanger 600 has a first hook portion 602 extending above a central body portion 604. First arm 606 extends laterally outward from the central body portion 604 to a first distal end 608. Second arm 610 extends laterally outward from the central body portion 604 to a second distal end 612.

Secured along first arm 606 is a first locking bar 614. First locking bar 614 extends from a first fixed end 614*a* inward towards central body portion 604 above first arm 614 to a first free end 614*b*. Secured along second arm 610 is a second locking bar 616. Second locking bar 616 extends from a second fixed end 616*a* inward towards central body portion 604 above second arm 610 to a second free end 616*b*. Alternately, either or both of locking bars 614, 616 may be secured at a point proximal to the central body portion, and extend outward to a distal free ends. In such an embodiment, the arms 606, 610 may also be level or provided with upward sweep.

Hanger 600 operates in a similar fashion to the embodiments shown in FIGS. 1 and 2, except that in this embodiment, the arm itself performs the function of the support bar. The article to be suspended is placed both between a locking bar and an arm, and above a locking bar. The weight of the article will deflect the locking bar into engagement with arm, securely holding the article by the portion therebetween.

In the above embodiments, the locking bars are generally illustrated secured at distal points, and extend inward, as are the support bars. However, either the support bars or the locking bars, irrespective of each other or of a complementary support or locking bar, may be secured at a proximal point, and extend distally, without departing from the scope of the invention.

The exemplary material contemplated for hangers according to the present invention is some form of plastic, particularly those suitable for high-volume injection molding, including, polystyrene, ABS, SAN, ADS, PPO, nylon, polypropylene, polyethylene, PET, polycarbonates, acrylics and PVC, among numerous other plastic compositions. Each composition may be provided with different colorings in conformance with the specific demands of the customer. Other materials are also suitable, including a variety of metals, dictated principally by the particular material properties, including but not limited to modulus of elasticity, and the resulting necessary dimensions in order to support and secure a range of anticipated loads to be suspended from the hanger. Such metals may be formed into the present invention by processes including casting, forging, bending, stamping, or powder metallurgy.

The present invention has been described with respect to certain exemplary and preferred embodiments. However, certain alterations or modifications will be apparent to those skilled in that art without departing from the scope of the invention. The foregoing descriptions are meant to be illustrative, and not limiting on the scope of the invention, which is defined by the appended claims.

The invention claimed is:

1. A hanger comprising:

a first hook portion extending above a central body portion;

first and second arms, each extending laterally outward from the central body portion to a respective first and second distal end;

a first locking bar having a first end secured distally along the first arm and extending inward towards the central body portion beneath the first arm to a free second end; and a first support bar having a third end secured distally along the first arm and extending inward towards the central body portion beneath the first locking bar to a fourth end, wherein the locking bar is dimensioned to deflect to interface the support bar under a predetermined minimum force.

2. The hanger according to claim 1, further comprising a second support bar having a fifth end secured distally along the second arm and extending inward towards the central body portion beneath the second arm to a sixth end; and a second locking bar having a seventh end secured distally along the second arm and extending inward towards the central body portion beneath the second arm and above the second support bar to a free eighth end.

3. The hanger according to claim 1, wherein the free second end of the first locking bar extends further inward towards the central body portion than the fourth end of the first support bar.

4. The hanger according to claim 1, wherein the fourth end of the first support bar is secured to a portion of the hanger.

5. The hanger according to claim 1, wherein a lower surface of the first locking bar and an upper surface of the first support bar are provided with complementary profiles which mate together to substantially eliminate substantially all space between the two.

6. The hanger according to claim 1, wherein the width of the first locking bar narrows from the first end to the second end.

7. The hanger according to claim 1, wherein at least one of the first and second arms is swept downward.

8. The hanger according to claim 1, wherein the first locking bar is swept upward, whereby the free second end is above the first end.

9. The hanger according to claim 1, wherein the first support bar is swept upward, whereby the fourth end is above the third end.

10. The hanger according to claim 1, further comprising an inclined edge rising above one of the first and second arms along a side of the central body portion.

11. The hanger according to claim 1, further comprising a recess formed in a top surface of one of the first and second arms.

12. The hanger according to claim 1, further comprising a flange along the top surface of one of the first and second arms.

13. The hanger according to claim 12, wherein the flange has a greater width in the region of the first or second distal end then in the region of the central body portion.

14. The hanger according to claim 1, further comprising a second hook extending beneath the first or second arm.

15. The hangar according to claim 1, further comprising an injection molded plastic material.

16. The hanger according to claim 2, wherein the sixth end of the second support bar is secured to a portion of the hanger.

17. The hanger according to claim 2, wherein the second support bar is swept upward, whereby the sixth end is above the fifth end.

18. A method for hanging a flexible article, the method comprising:

(a) providing a hanger having at least a hook portion, a support bar beneath the hook portion and a flexible locking bar having a free end, the flexible locking bar between the support bar and the hook portion;

(b) folding the flexible article over itself at least once;

(c) positioning one side of the folded article between the locking bar and the support bar, including deflecting the free end of the flexible locking bar in the lateral direction to assist in the positioning;

(d) positioning another side of the folded article above the locking bar; and (e) allowing the weight of the article to deflect the locking bar into engagement with the support, thereby securing the side of the folded article located therebetween.

19. The method for hanging a flexible article according to claim 18, further comprising suspending the hanger from a support structure by the hook portion.

20. The method for hanging a flexible article according to claim 18, wherein a lower surface of the locking bar and an upper surface of the support bar are provided with complementary profiles.

* * * * *